US005888351A

United States Patent [19]

Graf et al.

[11] Patent Number: 5,888,351

[45] Date of Patent: Mar. 30, 1999

[54] FELT STRETCHER IN A PAPER-MAKING MACHINE

[75] Inventors: Edwin X. Graf, Menasha; William Witte, Kaukauna, both of Wis.

[73] Assignee: Voith Sulzer Paper Technology North America, Inc., Appleton, Wis.

[21] Appl. No.: 934,584

[22] Filed: Sep. 22, 1997

[51] Int. Cl.[6] ..... D21F 7/00; B65H 20/32

[52] U.S. Cl. ..... 162/273; 162/274; 242/417.3; 242/417

[58] Field of Search ..... 162/272, 273, 162/274; 242/417, 417.3, 417.2, 447, 410, 420.2; 226/170, 172, 179; 26/71, 99, 74; 451/311; 474/101

[56] References Cited

U.S. PATENT DOCUMENTS

| | | | |
|---|---|---|---|
| 1,494,567 | 5/1924 | Aldrich | 162/273 |
| 1,582,322 | 4/1926 | Warren | 162/273 |
| 1,582,323 | 4/1926 | Warren | 162/273 |
| 5,587,052 | 12/1996 | Autio et al. | 162/273 |

*Primary Examiner*—Stanley S. Silverman
*Assistant Examiner*—José S. Fortuna
*Attorney, Agent, or Firm*—Taylor & Associates, P.C.

[57] ABSTRACT

A paper making machine for producing a continuous traveling fiber material web includes a roll having a longitudinal axis and two longitudinal ends. Each end has a concentric first circular gear with a plurality of radially outwardly facing teeth. A felt is carried by the roll. The paper making machine also includes a pair of parallel lower elongated racks extending substantially perpendicular to the longitudinal axis of the roll. Each lower elongated rack includes a plurality of teeth carrying and meshing with the teeth of a respective first circular gear. The roll is rotatably movable with respect to the lower racks in two opposite directions along and parallel to the lower racks and transverse to the longitudinal axis of the roll. A first of the two opposite directions is toward the felt. The paper making machine further includes a device for rotating and thereby moving at least one first circular gear along a respective lower rack such that the felt is stretched in the first of the two opposite directions.

20 Claims, 4 Drawing Sheets

FELT STRETCHER IN A PAPER-MAKING MACHINE

BACKGROUND OF THE INVENTION

1. Field of the Invention

The present invention relates to a paper-making machine, and, more particularly, to a paper-making machine including a felt.

2. Description of the Related Art.

Paper-making machines may include continuous belts such as so-called "felts" to conduct the paper web throughout the paper-making machine. These felts, also sometimes called "canvases," are carried by rotating rolls. A plurality of felts may be provided which successively carry the fiber web from one end of the paper-making machine to the other end. Such felts can generally be viewed as conveying, dewatering and drying felts. A drying felt traveling in a dryer section of a paper-making machine can contract or shrink due to the heat that the felt is exposed to within the dryer section, and can expand upon absorption of water from the paper web. Consequently, such drying felts may need to be stretched during operation.

It is known to stretch a felt carried by a roll by coupling each end of the roll to a separate gear box via cross shaft systems. The gear boxes, driven by electric motors, move the cross shafts, which, in turn, press the roll against the felt, thereby stretching the felt. The cross shafts may be attached to each end of a concentric axle of the roll. To stretch the felt, the roll can either be pulled toward or pushed away from the gear boxes by the cross shafts. A problem is that the gear boxes must be synchronized to exert substantially the same force to either end of the roll so that one end of the felt is not stretched more than the other end, and so that the roll does not become misaligned. This is particularly problematic in that the gear boxes must be synchronized while being separated by the approximately, e.g., 10 meter length of the roll. Electronic control may be needed to achieve this long distance synchronization. Another problem is that gear boxes and electronic controls are relatively expensive.

It is also known to stretch a felt carried by a roll by using an electric motor to tension a chain attached to one end of the roll axle, thereby pulling the roll into the felt. Another such device is attached to the other end of the roll axle. A problem is that, like the gear boxes, a substantially equal force must be applied to each end of the roll. Another problem is that such a device is not durable because it vibrates excessively in operation, shakes itself loose, and batters its components against themselves and other objects.

SUMMARY OF THE INVENTION

The present invention provides a felt stretching device including a lever arm and a mass cooperating to exert a rotational force on a roll carrying the felt, which rotation is converted to a lateral movement of the roll into the felt, thereby stretching the felt.

The invention comprises, in one form thereof, a paper making machine for producing a continuous traveling fiber material web including a roll having a longitudinal axis and two longitudinal ends. Each end has a concentric first circular gear with a plurality of radially outwardly facing teeth. A felt is carried by the roll. The paper making machine also includes a pair of parallel lower elongated racks extending substantially perpendicular to the longitudinal axis of the roll. Each lower elongated rack includes a plurality of teeth carrying and meshing with the teeth of a respective first circular gear. The roll is rotatably movable with respect to the lower racks in two opposite directions along and parallel to the lower racks and transverse to the longitudinal axis of the roll. A first of the two opposite directions is toward the felt. The paper making machine further includes a device for rotating and thereby moving at least one first circular gear along a respective lower rack such that the felt is stretched in the first of the two opposite directions.

An advantage of the present invention is that the teeth of the lower elongated racks on opposing ends of the roll allow both ends of the roll to be moved a substantially equal distance.

Another advantage of the present invention is that it is less expensive than the gear boxes and cross shaft systems which have been used previously.

Yet another advantage is that the present invention is more durable than a chain stretcher. The mechanism of the present invention which forces the roll against the felt moves very slowly, thus minimizing any impact forces and associated wear of the components.

A further advantage of the present invention is that it requires fewer components than the prior art, thus adding to its advantages in regard to durability and cost.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
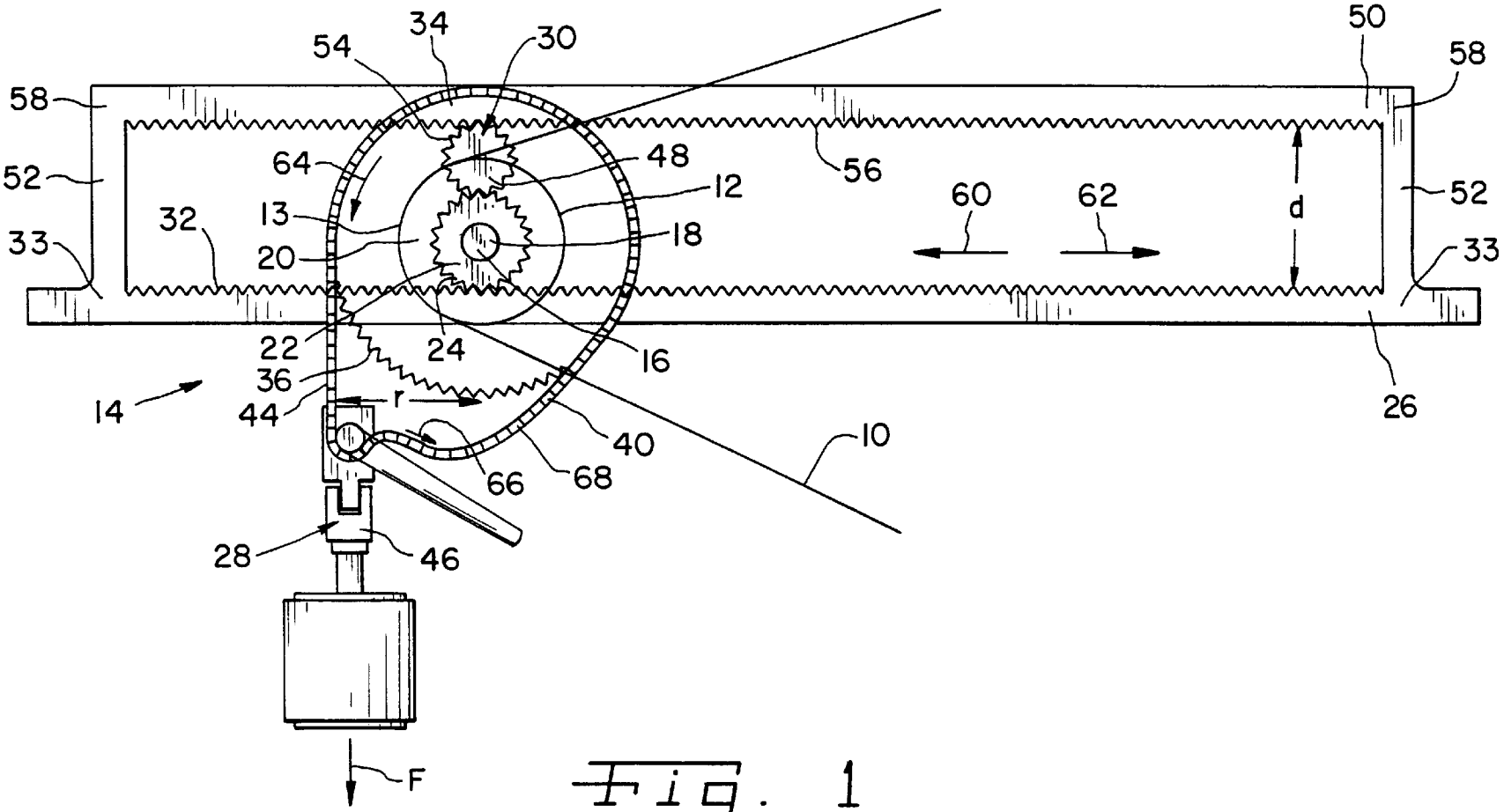
FIG. 1 is an end view of an embodiment of a portion of a paper-making machine including an embodiment of the felt stretcher of the present invention.
Figure 2:
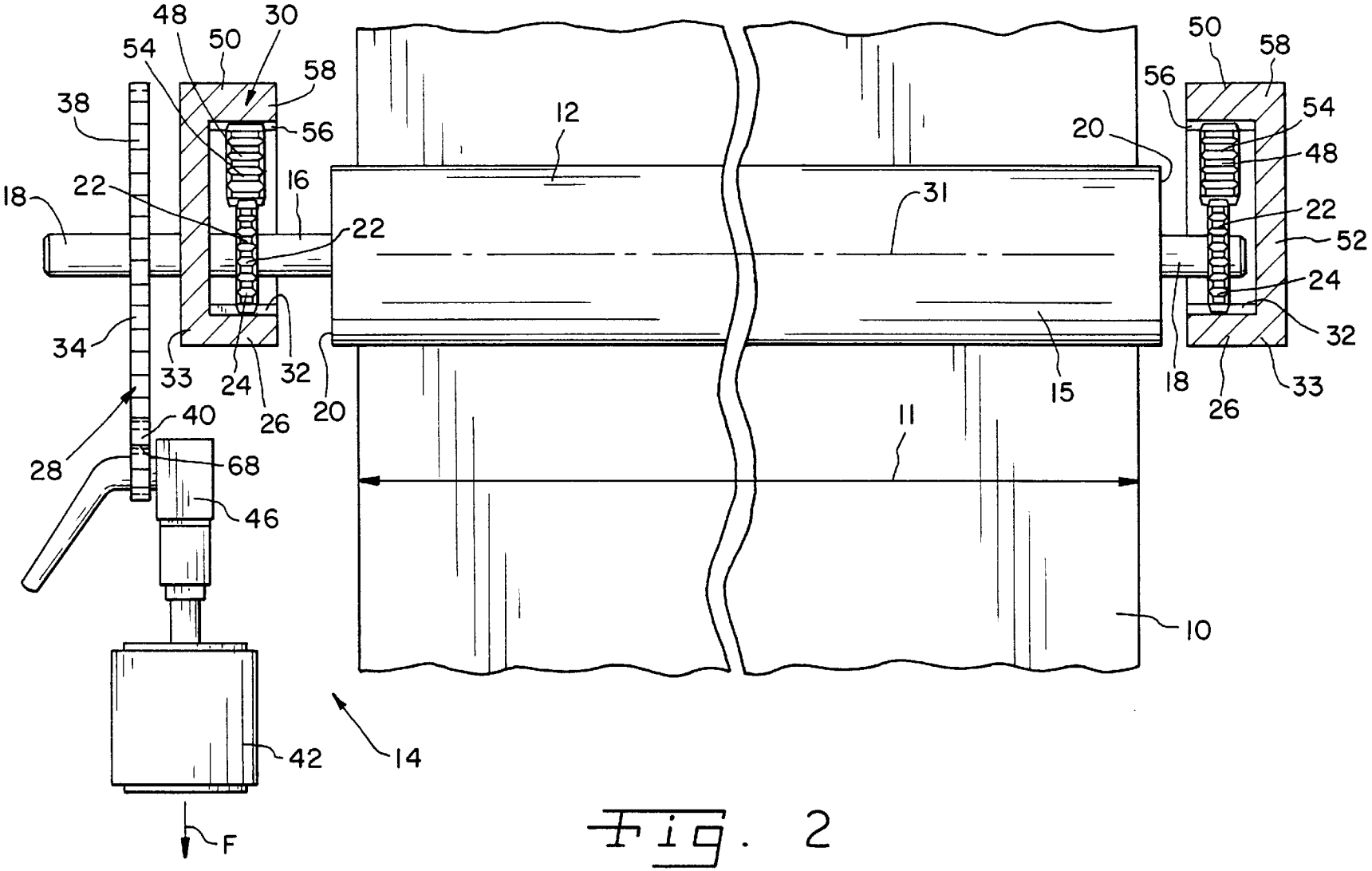
FIG. 2 is a side view of the paper-making machine and felt stretcher shown in FIG. 1.

Referring now to the drawings, and particularly to FIGS. 1 and 2, there is shown a partial view of an embodiment of a paper-making machine of the present invention including a felt 10, a rotating roll 12 and a felt stretcher 14. Felt 10 has a width 11 (FIG. 2). Felts are well known in the art and are not described in detail herein.

Roll 12 carries felt 10 around a predetermined portion of the periphery 13 thereof, defined by the entrance and exit angles of felt 10. Roll 12 includes a concentric axle 16 having two ends 18 extending longitudinally past either end 20 of roll 12. Each of two metal circular gears 22 is attached to a respective longitudinal end 18 of axle 16. Being concentric with both axle 16 and roll 12, gears 22 each have a plurality of radially outwardly facing teeth 24. As an alternative to gears 22, e.g., ends 20 of roll 12 can each have an integral plurality of outwardly facing teeth.

Felt stretcher 14 includes a pair of lower elongated racks 26, a rotating mechanism 28 and a biasing device 30. Lower elongated racks 26 extend parallel to each other and substantially perpendicular to longitudinal axis 31 of axle 16 and to width 11 of felt 10. Racks 26 have a plurality of upwardly facing teeth 32 along their lengths, extending to each opposite end 33 of racks 26. Each rack 26 is positioned adjacent and below a respective circular gear 22 such that teeth 32 of racks 26 carry and mesh with teeth 24 of gears 22.

Rotating mechanism 28 includes a second circular gear 34 attached to and substantially concentric with an end 18 of longitudinal axle 16. Second circular gear 34 is shown as being disposed longitudinally outside a first circular gear 22 with respect to roll 12, or, in other words, disposed on a side of gear 22 opposite from roll 12. However, it is to be understood that second gear 34 could also be placed between roll 12 and second gear 22 on axle 16. Second circular gear 34 has a plurality of outwardly facing teeth 36 forming connection points for an elongate connector such as a chain loop 40. Chain loop 40 hangs over circular gear 34, meshing with teeth 36 of second circular gear 34.

A mass 42 is attached to chain loop 40 and hangs therefrom. Mass 42, under the force of gravity, exerts a downward force F on chain loop 40, tensioning a portion 44 of chain loop 40. A ratchet 46 is used to secure mass 42 to chain loop 40. Ratchet 46 can also be used to lift and secure mass 42 to a vertically higher point on chain loop 40.

Biasing device 30 includes a pair of plastic circular pinions 48, a pair of upper elongated racks 50 and two pairs of frames 52 respectively interconnecting lower racks 26 and upper racks 50. Pinions 48 have a plurality of radially outwardly facing teeth 54 which mesh with teeth 24 of first circular gear 22. Upper elongated racks 50 extend parallel to each other and to lower elongated racks 26. Like lower racks 26, upper racks 50 extend substantially perpendicular to width 11 of felt 10. Racks 50 have a plurality of downwardly facing teeth 56 along their lengths, extending to each opposite end 58 of racks 50. Each rack 50 is positioned adjacent and above a respective circular pinion 48 such that teeth 54 of pinions 48 mesh with teeth 56 of upper racks 50. Each frame 52 interconnects a respective end 33 of a lower rack 26 and a respective end 58 of an upper rack 50.

In operation, roll 12 and longitudinal axle 16 are rotatable movable and have variable positions with respect to lower racks 26 in two opposite horizontal or lateral directions, indicated by arrows 60 and 62. Both directions 60 and 62 are along and parallel to lower racks 26 and transverse to felt width 11. Teeth 36 of second circular gears 34 and teeth 32 of lower racks 26 continue to mesh together as second circular gears 34 roll along lower racks 26 in directions 60 and 62. In FIG. 1, felt 10 is carried by a predetermined portion of periphery 13 of roll 12 such that roll 12 presses against and consequently stretches fell 10 when roll 12 is rotatably moved in direction 60. Rotating mechanism 28 exerts a rotational force on roll 12 in the direction of arrow 64, causing roll 12 to move laterally in direction 60, pressing into and thereby stretching felt 10. More particularly, the weight or force F of mass 42 due to gravity tensions portion 44 of chain loop 40 and applies a rotational force to second circular gear 34 in direction 64. The rotation of second circular gear 34 causes longitudinal axle 16 to rotate, which in turn results in lateral movement of roll 12 in direction 60, pressing roll 12 against and thereby stretching felt 10. The meshing together of teeth 24 of first circular gears 22 and teeth 32 of lower racks 26 keeps roll 12 parallel to and aligned with felt width 11 as roll 12 travels in either of directions 60 and 62. Thus, each first circular gear 22 is rotated and thereby moved a substantially equal distance as a result of rotating mechanism 28 exerting a rotational force on one of two longitudinal axle ends 18.

Teeth 36 of second circular gear 34 form connection points which are radially displaced from the variable position of longitudinal axle 16 and rigidly attached to longitudinal axle 16 through second gear 34. Chain loop 40, in the embodiment shown in FIG. 1, interconnects a plurality of teeth 36 and mass 42. This allows mass 42 to simultaneously exert a force in the direction of arrow 64 on a plurality of connection points in the form of teeth 36. The turning force exerted by mass 42 on second circular gear 34, and, in turn, on roll 12 is a torque or moment of force. The magnitude of such a moment of force is well known as the cross product of the force exerted and the distance between the point at which the force is exerted and the axis of rotation. In FIG. 1, the moment of force exerted by mass 42 on second circular gear 34 is approximately equal to the mathematical expression $F \times r$, wherein r is the radius of second circular gear 34. In general, the moment of force can be varied by adjusting either the force F exerted, or the moment arm. In the embodiment shown in FIGS. 1 and 2, the moment of force, and thus the rotational force of roll 12 and the consequent stretch of felt 10, can be varied by changing either the weight of mass 42 or radius r of second circular gear 34.

Biasing device 30 maintains teeth 24 of first circular gears 22 of roll 12 in contact with teeth 32 of lower racks 26 so that they continue to mesh together in alignment as roll 12 travels along lower racks 26. Frames 52 retain lower racks 26 and their respective upper racks 50 in mutual alignment. Frames 52 also determine a distance d between lower racks 26 and upper racks 50 such that pinions 48 and first circular gears 22 fit therein with predetermined clearance distances. Pinions 48 are fabricated of a relatively soft material such as plastic so that, in the event of any interference between a pinion 48 and a gear 22 as their teeth mesh together along the length of racks 26 and 50, pinion 48 will deform or yield to metal gear 22 and allow gear 22 to continue to turn. Although pinion 48 may yield to first circular gear 22, pinion 48 continues to bias gear 22 against lower rack 26. It is, of course, possible to bias teeth 24 of first circular gears 22 against teeth 32 of lower racks 26 using other configurations not shown in the drawings. For example, tracks having grooves for receiving teeth 24 could be aligned substantially parallel to lower racks 26. Such tracks, when rigidly connected to fixed structures, would effectively limit the vertical movement of gears 22. Alternatively, a spring or other resilient device could be used to exert a downward force on axle 16.

The function served by second circular gear 34 and chain loop 40 in combination can also be served by many different forms of hardware. For instance, a flat, square plate with radially displaced pegs projecting from its side and serving as connection points can be concentrically attached to axle 16. The elongate connector can be in the form of a rod with a hook hung over one of the pegs or a rope or cable tied to a peg. In general, a connection point is provided that is radially displaced from and rigidly connected to longitudinal axle 16 such that an elongate connector can be attached to the connection point. It is also possible to attach separate rotating mechanisms to each opposite end of longitudinal axle 16.

Figure 5:
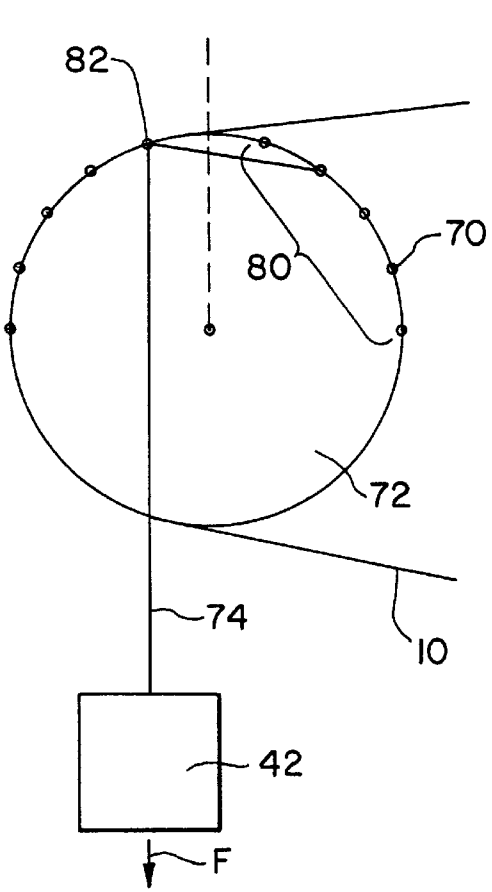
FIG. 5 is yet another schematic, partial end view of the felt stretcher of FIG. 3 wherein the mass is connected to yet another connection point.
Figure 4:
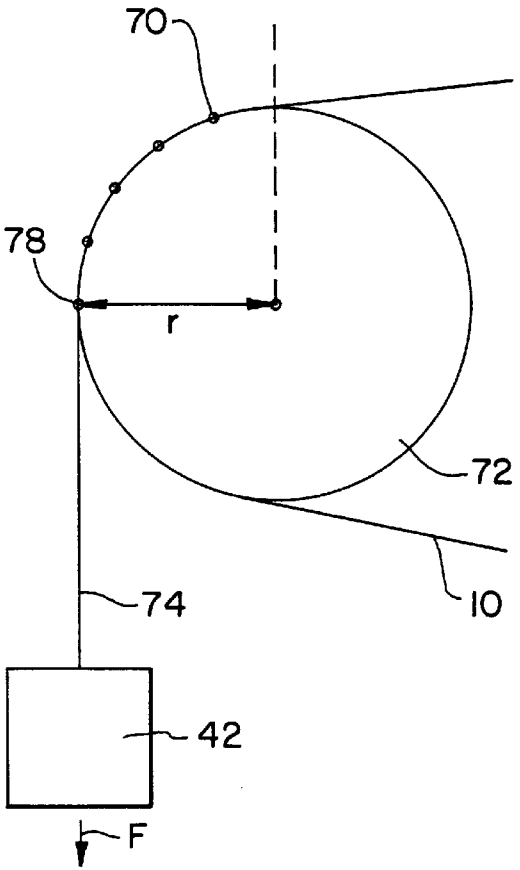
FIG. 4 is another schematic, partial end view of the felt stretcher of FIG. 3, wherein the mass is connected to a different connection point.
Figure 3:
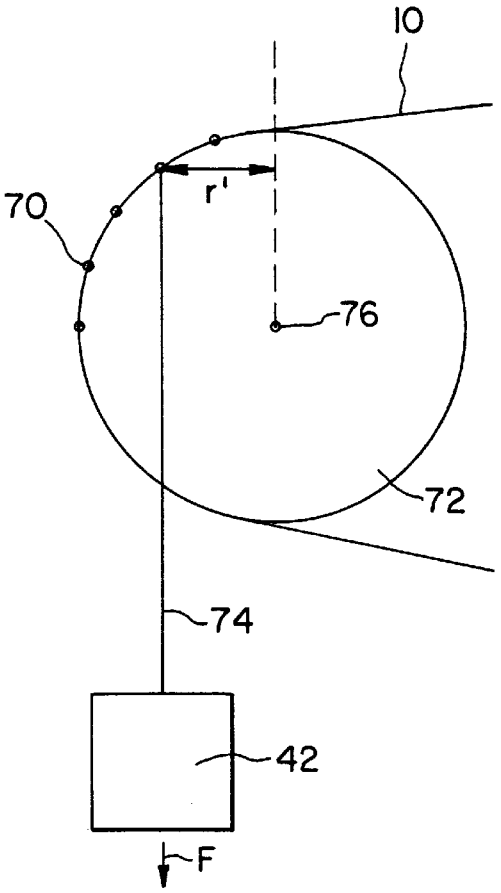
FIG. 3 is a schematic, partial end view of another embodiment of a felt stretcher of the present invention.

FIGS. 3–5 are schematic, partial end views of another embodiment of a rotating mechanism in which connection points are in the form of projections 70 spaced along the circumference of a circular disk 72 concentric with and rigidly attached to the longitudinal axle. Other parts of the paper making machine, including the biasing device, are substantially the same as shown in FIGS. 1–2 and are not shown in FIGS. 3–5 in order to simplify the drawings. Referring to FIG. 3, mass 42 is connected via an elongate connector 74 such as a chain, cable or rod, to a single connection point 70 displaced by a distance $r_1$ in the direction of felt stretch from center 76 of circular disk 72, and hence from the variable position of the longitudinal axle. When connecting mass 42 to a single connection point, the moment of force is maximized by connecting mass 42 to a connection point 73 that is substantially furthest most in the direction of felt stretch, as shown in FIG. 4. At point 78, mass 42 exerts a downward force F that is perpendicular to moment arm r, thereby maximizing the moment of force or torque. Using this principle, the moment of force, and thus the amount of felt stretch, can be varied by changing the projection 70 to which mass 42 is connected. For instance, if mass 42 were connected to projection 78 and it was desired to decrease the applied torque, mass 42 could be disconnected from projection 78 and connected to another projection 70 having a lesser displacement in the direction of felt stretch from the longitudinal axle. Conversely, if the applied moment of force needed to be increased, mass 42 could be connected to a projection 70 having a greater displacement in the general direction of felt stretch from the longitudinal axle. Projection 78 has the greatest such displacement available on circular disk 72.

Referring to FIG. 5, a subset 80 of projections 70 are radially displaced from the variable position of longitudinal axle 16 in the direction away from felt 10. When mass 42 is connected to a projection 70 from subset 80, an interconnecting flexible elongate connector 74, such as a chain or cable, must be hung over a pivot axle 82 radially displaced in the direction of felt stretch from the variable position of the longitudinal axle. Pivot axle 82 is on the felt side of circular disk 72 in order for mass 42 to exert a rotational force in the direction of felt stretch on the roll. Pivot axle 82 is shown in the form of a projection 70 rigidly connected to the longitudinal axle. However, pivot axle 82 can also be a separate fixed structure radially displaced from the longitudinal axle in the direction of felt stretch, but otherwise unconnected to the longitudinal axle.

Figure 6:
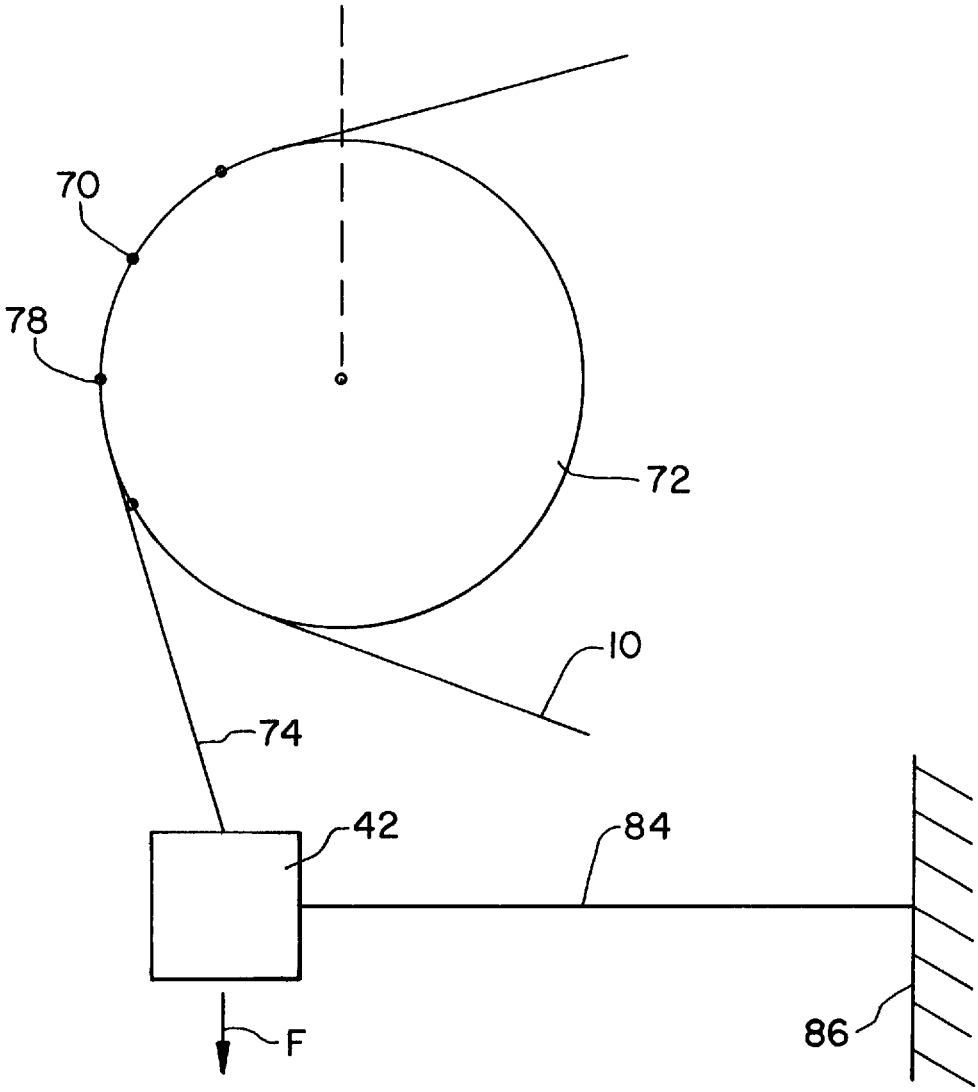
FIG. 6 is a schematic, partial end view of yet another embodiment of a felt stretcher of the present invention.

Another method of effectively changing the force F exerted by mass 42 is to connect mass 42, possibly through a rope or cable, to another fixed structure. Such a connection would serve to additionally tension elongate connector 74 and/or support a portion of the weight of mass 42. For example, in the embodiment shown in FIG. 6, mass 42 is horizontally tied or connected through a cable 84 to a wall 86 such that a horizontal component of tension, in addition to the vertically downward component attributable to mass 42, is exerted on elongate connector 74, effectively increasing the total torque exerted on circular gear 34. Similarly, mass 42 could be tied or attached to a point on wall 86 substantially vertically higher than mass 42, thereby supporting or offsetting a portion of the weight of mass 42, reducing the vertical component of tension in elongate connector 74, and effectively reducing the total torque exerted on circular gear 34. An analogous method of effectively reducing the moment of force exerted by mass 42 in the embodiment shown in FIG. 1 is by moving mass 42 along chain loop 40 in the direction indicated by arrow 66 until an opposite portion or leg 68 of chain loop 40 is partially tensioned and supports some portion of the weight of mass 42. Thus, the rotational force exerted by mass 42 upon second circular gear 34 in the direction of arrow 64 is partially offset by the tension in leg 68, which tension exerts a rotational force on gear 34 in the direction opposite to that of arrow 64. Mass 42 can be secured to chain loop 40 by ratchet 46 at this point.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A felt stretcher for a paper making machine comprising:

a roll including a longitudinal axis and two longitudinal ends, each said end having a concentric first circular gear with a plurality of radially outwardly facing teeth;

a felt carried by said roll;

a pair of parallel lower elongated racks extending substantially perpendicular to said longitudinal axis of said roll, each said lower elongated rack including a plurality of teeth carrying and meshing with said teeth of a respective said first circular gear, said roll being rotatably movable with respect to said lower racks in two opposite directions along and parallel to said lower racks and transverse to said longitudinal axis of said roll, a first of said two opposite directions being toward said felt; and means for rotating and thereby moving at least one said first circular gear along a respective said lower rack such that said felt is stretched in said first of said two opposite directions.

2. The felt stretcher of claim 1, further comprising means for biasing each of said first circular gears against said lower elongated racks.

3. The felt stretcher making machine of claim 2, wherein said biasing means comprises:

a pair of circular pinions, each said pinion having a plurality of radially outwardly facing teeth meshing with said teeth of a respective said first circular gear; and a pair of upper elongated racks extending substantially parallel to said respective lower elongated racks, each said upper elongated rack having a plurality of teeth meshing with said teeth of a respective said pinion.

4. The felt stretcher of claim 3, wherein each said lower elongated rack includes two opposite ends, and each said upper elongated rack includes two opposite ends, said biasing means including four frames, each said frame interconnecting a respective said end of a corresponding said lower elongated rack and a respective said end of a corresponding said upper elongated rack.

5. The felt stretcher of claim 1, wherein said first circular gears are comprised of metal and said circular pinions are comprised of plastic.

6. The felt stretcher of claim 1, wherein said roll includes a concentric longitudinal axle having a variable position relative to said racks in said two opposite directions, and wherein said rotating means comprises:

a second circular gear rigidly connected to said longitudinal axle and including a plurality of radially outwardly facing teeth;

a mass connected to at least one said tooth of said second circular gear; and a chain interconnecting said at least one tooth and said mass.

7. The felt stretcher of claim 6, wherein said mass exerts a rotational force on said second circular gear.

8. The felt stretcher of claim 1, wherein said roll includes a concentric longitudinal axle having a variable position relative to said racks in said two opposite directions, and wherein said rotating means comprises:

at least one connection point rigidly connected to said longitudinal axle, said at least one connection point being radially displaced from said variable position of said longitudinal axle;

a mass connected to at least one said connection point; and an elongate connector interconnecting said at least one connection point and said mass.

9. The felt stretcher of claim 8, further comprising a ratchet securing said mass to said elongate connector, said ratchet configured for lifting said mass.

10. The paper making machine of claim 8, wherein said longitudinal axle includes two opposite ends, a separate said rotating means being rigidly attached to and radially displaced from each said end of said longitudinal axle.

11. The felt stretcher of claim 8, wherein each said first circular gear is attached to a respective said end of said longitudinal axle.

12. The felt stretcher of claim 8, wherein said rotating means is configured for rotating and thereby moving each said first circular gear a substantially equal distance in said direction of felt stretch.

13. The felt stretcher of claim 8, wherein said at least one connection point is radially displaced in said direction of felt stretch from said variable position of said longitudinal axle.

14. The felt stretcher of claim 8, wherein a second of said two opposite directions is away from said felt, and wherein said at least one connection point is radially displaced in said second direction from said variable position of said longitudinal axle, wherein said rotating means includes a pivot axle radially displaced in said direction of felt stretch from said variable position of said longitudinal axle, and wherein said elongate connector is flexible and hangs over said pivot axle.

15. The felt stretcher of claim 14, wherein said pivot axle is rigidly attached to said longitudinal axle.

16. The felt stretcher of claim 8, wherein said at least one connection point is disposed on a plate attached to said longitudinal axle.

17. The felt stretcher of claim 16, wherein said plate comprises a circular disk substantially concentric with said longitudinal axle.

18. The felt stretcher of claim 17, wherein one said connection point is disposed at a point on said circular disk substantially furthest most in said direction of felt stretch.

19. The felt stretcher of claim 17, wherein said at least one connection point comprises at least one projection projecting from said circular disk.

20. The felt stretcher of claim 19, wherein said elongate connector comprises one of a chain and a cable.

* * * * *

UNITED STATES PATENT AND TRADEMARK OFFICE

CERTIFICATE OF CORRECTION

PATENT NO. : 5,888,351

DATED : March 30, 1999

INVENTOR(S) : Edwin X. Graf and William Witte

It is certified that error appears in the above-identified patent and that said Letters Patent is hereby corrected as shown below:

Column 3

Line 52, delete "rotatable" and substitute --rotatably-- therefore.

Column 5

Line 21, delete "73" and substitute --78-- therefore.

Column 6

Line 47, delete "making machine" therefore.

Signed and Sealed this

Seventeenth Day of August, 1999

*Attest:*

Q. TODD DICKINSON

*Attesting Officer*

*Acting Commissioner of Patents and Trademarks*